US009669369B1

(12) United States Patent
Mees

(10) Patent No.: US 9,669,369 B1
(45) Date of Patent: Jun. 6, 2017

(54) MIXING BUCKET STABILIZING ASSEMBLY

(71) Applicant: Ryan L. Mees, Alpena, SD (US)

(72) Inventor: Ryan L. Mees, Alpena, SD (US)

( * ) Notice: Subject to any disclaimer, the term of this patent is extended or adjusted under 35 U.S.C. 154(b) by 0 days.

(21) Appl. No.: 13/963,652

(22) Filed: Aug. 9, 2013

(51) Int. Cl.
*B01F 15/00* (2006.01)

(52) U.S. Cl.
CPC .. *B01F 15/00772* (2013.01); *B01F 15/00662* (2013.01)

(58) Field of Classification Search
CPC .. B25B 5/00; B25B 11/00; B25B 5/06; B25B 5/105; B44D 3/14; E04D 15/00; B01F 15/00733; B01F 15/00662
USPC ..... 248/158, 161, 157, 163.1, 176.1, 188.1, 248/188.2, 188.8, 146, 154, 346.01, 121, 248/122.1, 125.8; 366/129, 605, 349, 366/341, 348; 220/630
See application file for complete search history.

(56) References Cited

U.S. PATENT DOCUMENTS 279,238 A * 6/1883 Geiger ..... A47J 37/0763 126/30
753,942 A * 3/1904 Wallace ..... B44D 3/14 211/85.21
2,482,704 A * 9/1949 Colfiesh ..... A47G 23/0216 220/737
2,508,802 A * 5/1950 Schade ..... B42F 17/02 108/26
3,352,311 A * 11/1967 Murphy ..... B08B 3/12 134/118
3,957,176 A * 5/1976 Marston ..... B44D 3/14 222/146.5
4,747,352 A * 5/1988 Guidry ..... A47B 37/00 108/26
5,232,188 A 8/1993 Troncone
5,380,033 A * 1/1995 Harling ..... B62B 1/12 280/47.19
5,511,753 A * 4/1996 Lage ..... 248/238
5,794,639 A * 8/1998 Einbinder ..... A61H 3/04 135/66
5,839,602 A * 11/1998 Mowry ..... B44D 3/14 220/737
6,027,128 A 2/2000 Stich et al.
6,135,467 A * 10/2000 Tagariello ..... B62B 3/104 280/79.11
6,227,513 B1 * 5/2001 Richard ..... A47G 7/025 211/43
6,241,204 B1 6/2001 Bermes
6,361,001 B1 3/2002 Durand
6,464,184 B1 * 10/2002 Lytle ..... B01F 15/00733 248/126
6,533,227 B1 * 3/2003 Rom ..... E04D 15/00 248/148

(Continued)

*Primary Examiner* — Muhammad Ijaz

(57) ABSTRACT

A mixing bucket stabilizing assembly includes a base that has a top side, a bottom side and a perimeter edge extending between the top and bottom sides. A bracket is attached to the top side of the base. The bracket releasably engages a mixing bucket. A plurality of legs is attached to and extends downwardly from the bottom side. A frame is attached to and extends upwardly from the base. The frame has a central aperture extending therethrough. The central aperture is aligned with the bracket and extends around the mixing bucket. The mixing bucket is frictionally engaged by the bracket to retain the mixing bucket on the base while material within the mixing bucket is mixed.

7 Claims, 3 Drawing Sheets

(56) References Cited

U.S. PATENT DOCUMENTS 6,634,785 B2 * 10/2003 French ..... B01F 13/002 366/347
6,776,379 B2 * 8/2004 Sherer ..... B65D 25/24 248/150
6,779,915 B2 8/2004 Foster, Jr.
7,018,090 B2 * 3/2006 Moore ..... B01F 15/00733 248/146
7,059,575 B2 6/2006 Garton
7,178,766 B2 2/2007 Forshee et al.
7,494,097 B2 * 2/2009 Lidie ..... B01F 15/00733 248/126
7,494,103 B1 * 2/2009 Huebner ..... B01F 15/00733 248/310
7,651,060 B2 * 1/2010 Roth ..... B01F 15/00733 248/146
8,011,701 B2 9/2011 Taylor
8,167,254 B2 * 5/2012 Hopkins ..... B65F 1/12 248/137
8,256,731 B2 9/2012 Wickwire
8,333,500 B1 * 12/2012 Melvin ..... E04D 15/00 248/146
8,376,376 B2 2/2013 Thibault
9,004,309 B1 * 4/2015 Gardner ..... B01F 15/00733 220/495.01
2003/0076738 A1 * 4/2003 Blakeman, II ..... B01F 11/0008 366/209
2003/0142583 A1 * 7/2003 Santospago ..... B01F 11/0008 366/209
2003/0146352 A1 * 8/2003 Zagorsky ..... B01F 15/00733 248/146
2003/0221692 A1 * 12/2003 Jones ..... 128/845
2003/0223306 A1 * 12/2003 Foster, Jr. ..... B01F 15/00733 366/129
2004/0085855 A1 * 5/2004 Midas ..... B01F 9/0001 366/209
2004/0183268 A1 9/2004 Hartsock
2005/0195685 A1 * 9/2005 Marshall et al. ..... 366/217
2006/0124808 A1 * 6/2006 Hibbler ..... B01F 15/00733 248/146
2007/0140049 A1 * 6/2007 Johnson ..... B01F 9/0001 366/209
2007/0252051 A1 * 11/2007 Kuipers ..... B01F 15/00733 248/146
2009/0256034 A1 10/2009 Poyner
2011/0198457 A1 * 8/2011 Rauchut ..... 248/154
2012/0110903 A1 * 5/2012 Adams ..... A47G 7/02 47/39
2012/0168591 A1 * 7/2012 Cimaglio ..... B01F 15/00772 248/346.04
2016/0051951 A1 * 2/2016 Gorra ..... B28C 5/10 211/70.6

* cited by examiner

MIXING BUCKET STABILIZING ASSEMBLY

BACKGROUND OF THE DISCLOSURE

Field of the Disclosure

The disclosure relates to mixing bucket holders and more particularly pertains to a new mixing bucket holder for holding a mixing bucket in a stationary position while viscous material, such as drywall compound, is mixed in the mixing bucket and thereby allows the material to be mixed by single person.

SUMMARY OF THE DISCLOSURE

An embodiment of the disclosure meets the needs presented above by generally comprising a base that has a top side, a bottom side and a perimeter edge extending between the top and bottom sides. A bracket is attached to the top side of the base. The bracket is configured to releasably engage a mixing bucket. A plurality of legs is attached to and extends downwardly from the bottom side. A frame is attached to and extends upwardly from the base. The frame has a central aperture extending therethrough. The central aperture is aligned with the bracket and is configured to extend around the mixing bucket when the mixing bucket is being held to the base by the bracket. The mixing bucket is frictionally engaged by the bracket to retain the mixing bucket on the base while material within the mixing bucket is mixed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
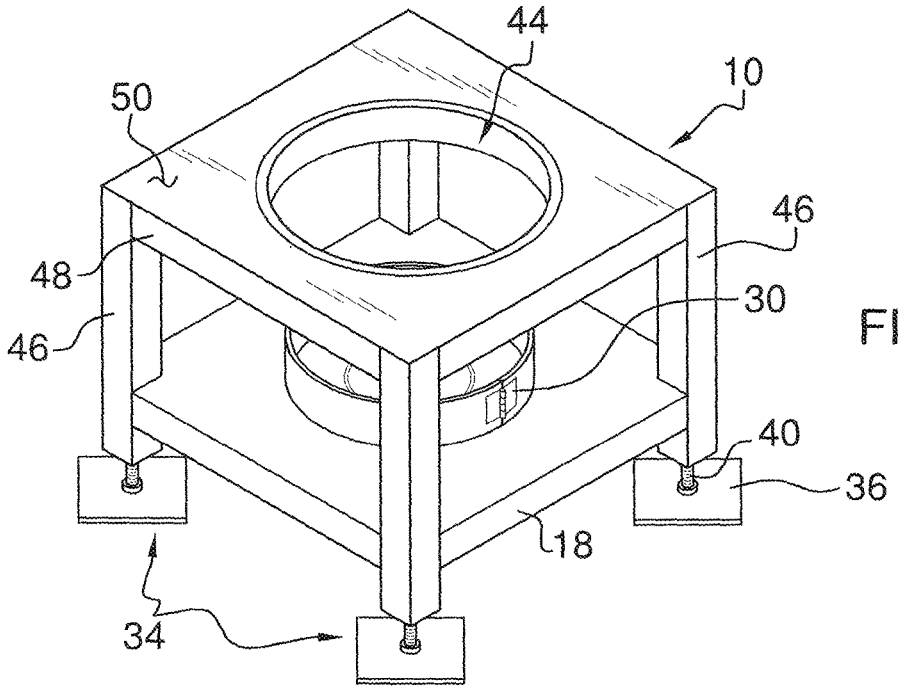
FIG. 1 is a rear perspective view of a mixing bucket stabilizing assembly according to an embodiment of the disclosure.
Figure 2:
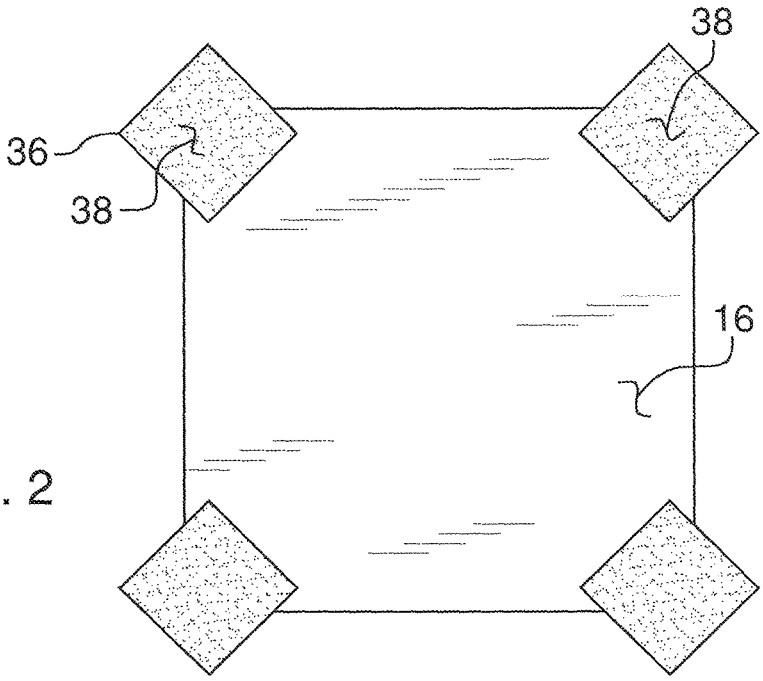
FIG. 2 is a bottom view of an embodiment of the disclosure.
Figure 3:
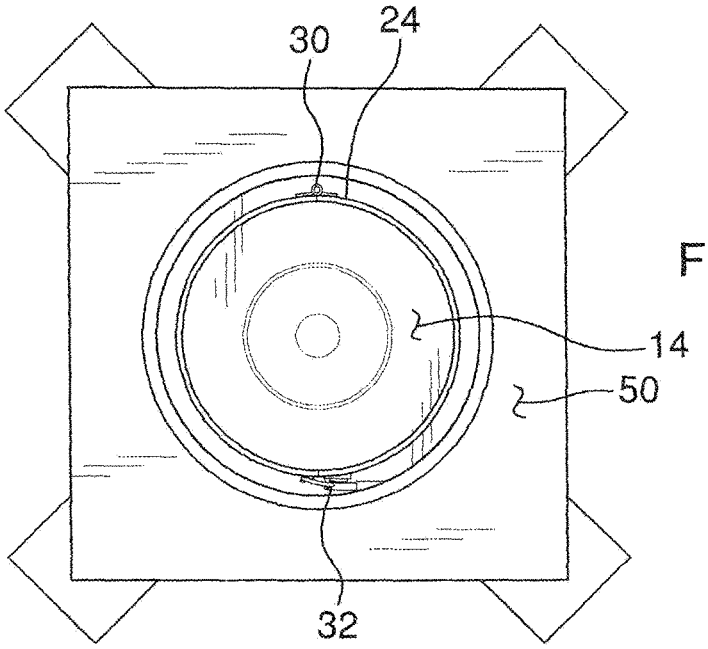
FIG. 3 is a top view of an embodiment of the disclosure.

With reference now to the drawings, and in particular to FIGS. 1 through 5 thereof, a new mixing bucket holder embodying the principles and concepts of an embodiment of the disclosure and generally designated by the reference numeral 10 will be described.

As best illustrated in FIGS. 1 through 5, the mixing bucket stabilizing assembly generally comprises a base 12 that has a top side 14, a bottom side 16 and a perimeter edge 18 extending between the top 14 and bottom 16 sides. The top side 14 may have a generally rectangular shape with four corners, though other shapes may be utilized. The base 12 may has a length and width equal each generally between 30.0 cm and 50.0 cm.

A bracket 20 is attached to the top side 14 of the base 12. The bracket 20 is configured to releasably engage a mixing bucket 22 and more particularly to frictionally engage the mixing bucket 22 to retain it on the base 12. The bracket 20 includes an annular member 24 extending upwardly from the top side 14. The annular member 24 includes a first section 26 and a second section 28 hingedly coupled together by a hinge 30. However, the first 26 and second 28 sections may also simply be pivotal with respect to each other by virtue of a resiliently flexible material such as a thin metal or a plastic material. Alternatively, the first 26 and second 28 sections may be rigid and pivotally coupled together with a flexible material. The first section 26 is fixedly and non-movably coupled to the top side 14 and the second section 28 is pivotable with respect to the first section 26 such that the second section 28 may be moved toward the first section 26 in an engaged position or away from the first section 26 in a disengaged position. The first section 26 may be attached to the top side 14 in any conventional manner such as with fasteners, welding or having the base and first section molded as a single piece of material. A locking member 32 releasably locks the second section 28 in the engaged position. It should be understood that the term "annular" is defined to mean a closed loop which may include the first section 26, the second section 28 and the locking member 32 and therefore will approximate a circle cut will generally not form a perfect circle. The locking member 32 may comprise a latch, and more particularly a draw latch, urging the second section 28 toward the first section 26 when the latch, or locking member 32, is actuated to the engaged position.

Figure 4:
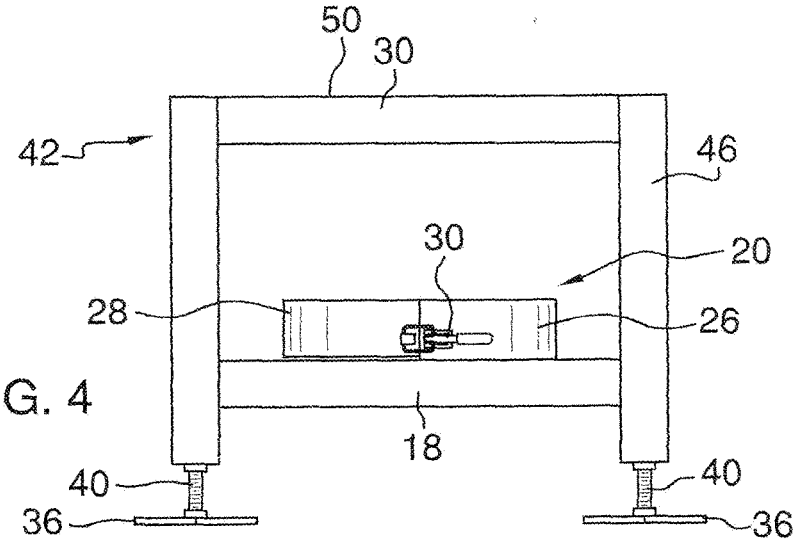
FIG. 4 is a front view of an embodiment of the disclosure.
Figure 5:
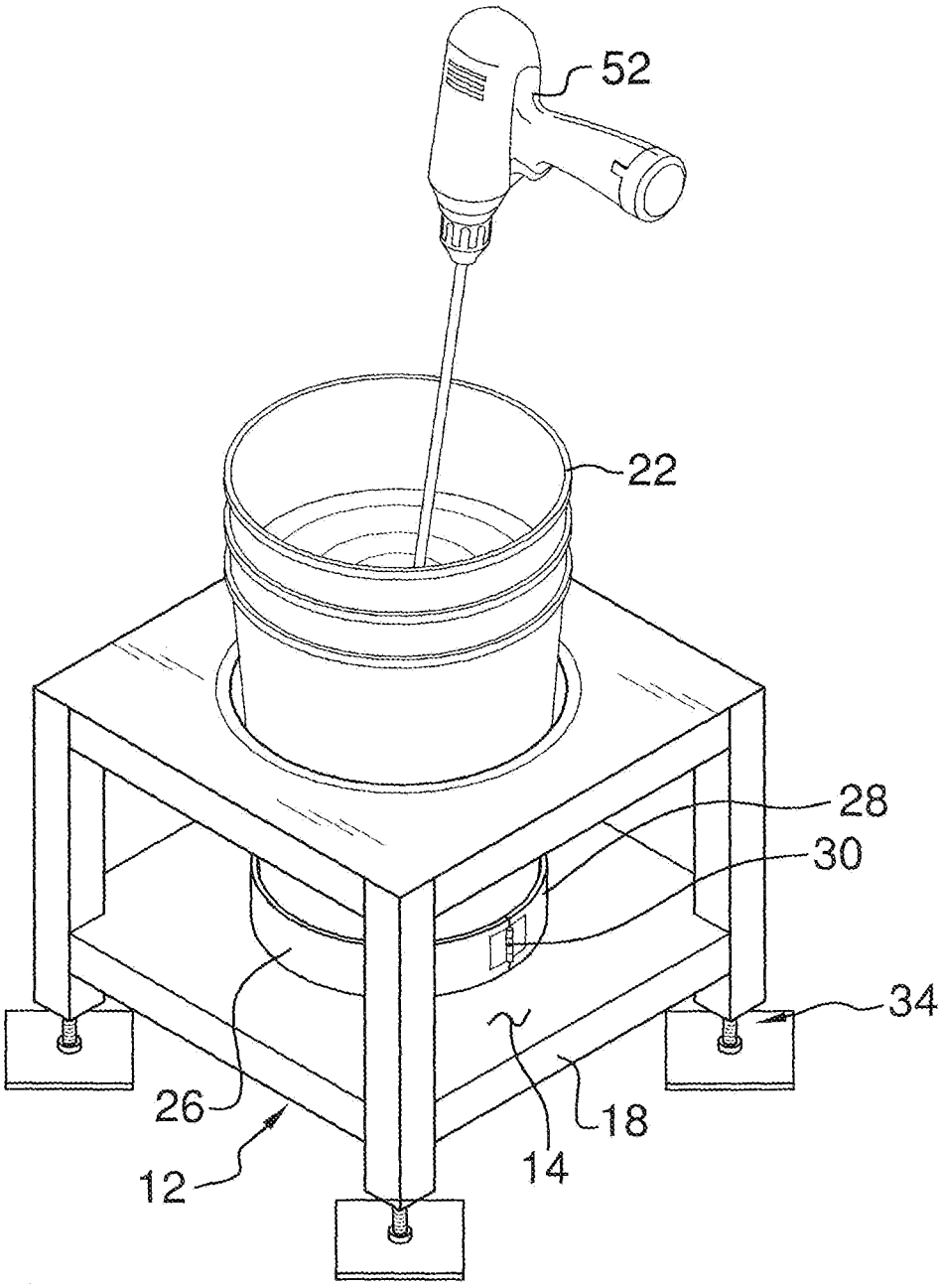
FIG. 5 is a perspective in-use view of an embodiment of the disclosure.

A plurality of legs 34 may be attached to the bottom side 16, or to the base 12 in general, such that each extends downwardly from the bottom side 16. Each of the legs 34 includes a foot 36 positioned distal to the base 12. Each foot 36 has a planar bottom surface 38 comprising a non-slip surface. The non-slip surface may comprise a rubberized surface or a roughed surface. The legs 34 may further each have an adjustable height such that a distance between each foot 36 and the base 12 is selectively adjustable. One way of achieving this, as shown in FIG. 4, includes threaded portions 40 of the legs 34 which are threadably coupled to the base 12, or to a fixed leg portion attached to the base 12, which allows the feet 36 to be moved upwardly when the threaded portions 40 are rotated in a first direction and downwardly when the threaded portions 40 are rotated in a second direction. The feet 36 may each extend outwardly beyond the perimeter edge 18 of the base 12. The boundary of the perimeter edge 18 is a vertical wall extending downwardly from the perimeter edge 18. By extending the feet outwardly through this boundary, such that they are not fully covered by the base 12, the feet 36 may be stepped upon by a user to further stabilize the assembly 10.

A frame 42 is attached to and extends upwardly from the base 12. The frame 42 has a central aperture 44 extending therethrough. The central aperture 44 is aligned with the bracket 20 and is configured to extend around the mixing bucket 22 when the mixing bucket 22 is held to the base 12 by the bracket 20. The central aperture 44 is circular and may have a diameter generally between 25.0 cm and 33.0 cm. The frame 42 includes a plurality of posts 46 extending upwardly from the base 12. An upper wall 48 is attached to the posts 46 distal to the base 12 and extends over the top side 14. The central aperture 44 extends through the upper wall 48. An upper surface 50 of the upper wall 48 is spaced from the top side 14 a distance generally between 15.0 cm and 35.0 cm. Each of the posts 46 is positioned adjacent to one of the corners.

In use, the mixing bucket 22 is placed on the top side 14, within the bracket 20, and the bracket 20 is closed to frictionally engage the mixing bucket 22. The inner surface of the bracket 20 facing the mixing bucket 22 may be roughened, knurled, have a diamond pattern, or include an elastomeric coating to increase friction between the bracket 20 and the mixing bucket 22. Material placed within the mixing bucket 22, such as drywall compound, texturing material, plaster or the like is then mixed within the mixing bucket 22 with an electric mixer 52. The bracket 20 and the frame 42 prevent the bucket 22 from rotating and from rocking back and forth which would dislodge the mixing bucket 22 from the bracket 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mixing stand assembly configured to retain a mixing bucket while material within the mixing bucket is mixed, said mixing stand assembly including:

a base being defined by a lower wall having a top side, a bottom side and a perimeter edge extending between said top and bottom sides;

a releasable bracket being attached to said top side of said base, said bracket being configured to releasably engage the mixing bucket, said bracket being bounded by and spaced from said perimeter edge;

a plurality of legs being attached to and extending downwardly from said bottom side, each of said legs includes a foot positioned distal to said base, said plurality of legs being four legs;

a frame being attached to and extending upwardly from said base, said frame being at a fixed angle with respect to said base, said frame having a central aperture extending therethrough, said central aperture being aligned with said bracket and being configured to extend around the mixing bucket when said mixing bucket is being held to said base by said bracket, said bracket and said aperture each being vertically oriented, at least a portion of said bracket being in a fixed position relative to said base and said aperture, said frame include a plurality of posts extending upwardly from said base, an upper wall being attached to said posts distal to said base and extending over said top side, said central aperture extending through said upper wall; and wherein said bracket is configured to frictionally engage the mixing bucket to retain said mixing bucket on said base while material within the mixing bucket is being mixed.

2. The mixing stand assembly according to claim 1, wherein said bracket includes an annular member extending upwardly from said top side, said annular member including a first section and a second section hingedly coupled together, said first section being fixedly and non-movably coupled to said top side, said second section being pivotable with respect to said first section such that said second section may be moved toward said first section in an engaged position or away from said first section in a disengaged position, a locking member releasably locking said second section in said engaged position.

3. The mixing stand assembly according to claim 2, wherein said locking member comprises a latch urging said second section toward said first section when said latch is actuated to said engaged position.

4. The mixing stand assembly according to claim 1, wherein each of said legs has an adjustable height such that a distance between each foot and said base is selectively adjustable.

5. The mixing stand assembly according to claim 1, wherein said top side has a generally rectangular shape and has four corners, each of said posts being positioned adjacent to one of said corners.

6. The mixing stand assembly according to claim 1, wherein said base has a length and width equal each generally between 30.0 cm and 50.0 cm, an upper surface of said upper wall being spaced from said top side a distance generally between 15.0 cm and 35.0 cm.

7. A mixing stand assembly configured to retain a mixing bucket while material within the mixing bucket is mixed, said mixing stand assembly including:

a base having a top side, a bottom side and a perimeter edge extending between said top and bottom sides, said top side having a generally rectangular shape and having four corners;

a bracket being attached to said top side of said base, said bracket being configured to releasably engage the mixing bucket, said bracket including an annular member extending upwardly from said top side, said annular member including a first section and a second section hingedly coupled together, said first section being fixedly and non-movably coupled to said top side, said second section being pivotable with respect to said first section such that said second section may be moved toward said first section in an engaged position or away from said first section in a disengaged position, a locking member releasably locking said second section in said engaged position, said locking member comprising a latch urging said second section toward said first section when said latch is actuated to said engaged position;

a plurality of legs being attached to and extending downwardly from said bottom side, said plurality of legs comprising four legs, each of said legs including a foot positioned distal to said base, each foot having a bottom surface comprising a non-slip surface, each of said legs having an adjustable height such that a distance between each foot and said base is selectively adjustable, said feet each extending outwardly beyond the perimeter edge of said base;

a frame being attached to and extending upwardly from said base, said frame being at a fixed angle with respect to said base, said frame having a central aperture extending therethrough, said central aperture being aligned with said bracket and being configured to extend around the mixing bucket when said mixing bucket is being held to said base by said bracket, said frame including a plurality of posts extending upwardly from said base, an upper wall being attached to said posts distal to said base and extending over said top side, said central aperture extending through said upper wall, each of said posts being positioned adjacent to one of said corners;

said base having a length and width equal each generally between 30.Ocm and 50.Ocm, an upper surface of said upper wall being spaced from said top side a distance generally between 15.0 cm and 35.0 cm; and wherein said bracket is configured to frictionally engage the mixing bucket to retain said mixing bucket on said base while material within the mixing bucket is being mixed.

* * * * *